US006476555B1

(12) United States Patent
Yoshida et al.

(10) Patent No.: US 6,476,555 B1
(45) Date of Patent: Nov. 5, 2002

(54) LONG-LIFE METAL HALIDE LAMP

(75) Inventors: Masato Yoshida, Takatsuki (JP); Takayuki Murase, Takatsuki (JP)

(73) Assignee: Matsushita Electric Industrial Co., Ltd., Osaka-fu (JP)

( * ) Notice: Subject to any disclaimer, the term of this patent is extended or adjusted under 35 U.S.C. 154(b) by 0 days.

(21) Appl. No.: 09/523,485

(22) Filed: Mar. 10, 2000

(30) Foreign Application Priority Data

Mar. 16, 1999 (JP) ..... 11-069746

(51) Int. Cl.[7] ..... H01J 17/04
(52) U.S. Cl. ..... 313/623; 313/631
(58) Field of Search ..... 313/623, 631, 313/331, 333, 283, 491, 632, 621

(56) References Cited

U.S. PATENT DOCUMENTS

| | | | | |
|---|---|---|---|---|
| 4,559,472 | A | | 12/1985 | Triebel et al. |
| 4,968,916 | A | | 11/1990 | Davenport et al. |
| 5,107,165 | A | | 4/1992 | Dever et al. |
| 5,598,063 | A | | 1/1997 | Mathews et al. |
| 5,936,350 | A | | 8/1999 | Yoshida et al. |
| 6,121,729 | A | | 9/2000 | Takao et al. |
| 6,137,228 | A | * | 10/2000 | Aizawa et al. ..... 313/631 |

FOREIGN PATENT DOCUMENTS

| | | |
|---|---|---|
| DE | 19812298 | 10/1998 |
| EP | 858098 | 8/1998 |
| JP | 4320600 | 8/1968 |
| JP | 60264040 | 12/1985 |
| JP | 8255594 | 10/1996 |
| JP | 10223175 | 8/1998 |

* cited by examiner

*Primary Examiner*—Sandra O'Shea
*Assistant Examiner*—Bao Truong
(74) *Attorney, Agent, or Firm*—Price and Gess

(57) ABSTRACT

A metal halide lamp has a long life since the temperature of the electrodes can be prevented from excessively rising. The metal halide lamp has an arc tube 3 that is composed of a light emitting part 1 and a sealing part 2 at each end of the light emitting part 1. A pair of electrodes 4 are extended from the ends of the arc tube 3 into the discharge chamber of the light emitting part 1 so that the discharge side ends of the electrodes 4 face each other. The other end of each electrode 4 is connected to a conductor 5 sealed in the sealing part 2. A part of the electrode 4, sealed in the sealing part 2, from the boundary between the light emitting part 1 and the sealing part 2 to the discharge side end of the conductor 5 is referred to as the electrode sealing part L. A metal member 7 partially covers the electrode sealing part L. The ratio of the weight A (mg) of the metal member 7 to the weight B (mg) of the electrode sealing part L is defined as an inequality $0.2 \leqq A/B \leqq 1.6$.

17 Claims, 5 Drawing Sheets

Fig. 3

| | A/B | luminous flux maintenance factor(%) | luminous efficacy(lm/W) |
|---|---|---|---|
| example 1 | 0.2 | 60 | 95 |
| example 2 | 0.4 | 65 | 90 |
| example 3 | 0.8 | 70 | 90 |
| example 4 | 1.0 | 70 | 90 |
| example 5 | 1.4 | 70 | 85 |
| example 6 | 1.6 | 75 | 80 |
| comparative example 1 | 0.1 | 55 | 95 |
| comparative example 2 | 2.0 | 75 | 70 |

Fig. 4

| | $I_{la}/D$ | luminous flux maintenance factor(%) | extinguishment |
|---|---|---|---|
| example 7 | 1.2 | 70 | not occur |
| example 8 | 1.7 | 70 | not occur |
| example 9 | 2.0 | 65 | not occur |
| example 10 | 2.5 | 60 | not occur |
| comparative example 3 | 1.0 | 65 | occur |
| comparative example 4 | 2.8 | 45 | not occur |

Fig. 5

| | d/OD | luminous flux maintenance factor(%) | crack |
|---|---|---|---|
| example 11 | 0.5 | 65 | not found |
| example 12 | 1.6 | 70 | not found |
| example 13 | 2.3 | 70 | not found |
| example 14 | 3.5 | 70 | not found |
| comparative example 5 | 0.2 | 50 | not found |
| comparative example 6 | 4.0 | 70 | found |

LONG-LIFE METAL HALIDE LAMP

This application is based on application No. 11-69746 filed in Japan, the content of which is hereby incorporated by reference.

BACKGROUND OF THE INVENTION (1) Field of the Invention

The present invention relates to a metal halide lamp that is used as a headlight or the like.

(2) Description of Related Art

When a metal halide lamp is used as a headlight, the illuminance of the lamp should reach a predetermined level promptly after the lamp is started up so as to ensure the safety. In general, by the passage of a high run-up current through electrodes of the lamp upon start-up, adequate luminous flux is generated to attain the predetermined level of the illuminance in a short period of time after the lamp is started up.

However, the passage of the high run-up current through the electrodes causes an excessive rise in the temperature of the electrodes. As the temperature of the electrodes excessively rises, there may be a possibility that material used for making the electrodes is dispersed. Due to the dispersed material, undesirable effect may be given to the lamp life. One of the subjects in manufacturing metal halide lamps has been increasing their lives.

SUMMARY OF THE INVENTION

It is therefore an object of the present invention to provide a long-life metal halide lamp.

The inventor of the present invention conducted analysis from the various viewpoints. As a result of the analysis, the inventor found that the temperature of an electrode can be prevented from excessively rising upon start-up of the lamp by covering the electrode with a metal member in such a manner as to satisfy a certain condition.

The object of the present invention can be achieved by A metal halide lamp made up of: an arc tube made up of a light emitting part and a sealing part at each end of the light emitting part, the light emitting part including a discharge chamber that contains a metal halogen substance; a pair of electrodes that each extend from the sealing part and have inner and outer ends, the inner ends facing each other at a predetermined distance in the discharge chamber so that discharge takes place between the facing inner ends, and the outer ends being sealed in the sealing parts and connected to conductors sealed in the sealing parts; and a pair of metal members that are attached to the pair of electrodes in a one-to-one relationship, each metal member partially covering an electrode within a length measured along the electrode from a boundary between the light emitting part and the sealing part to an inner end of the conductor, wherein an inequality $0.2 \leqq A/B \leqq 1.6$ is satisfied, where A is a weight (mg) of the metal member and B is a weight (mg) of a part of the electrode between the boundary and the inner end of the conductor.

With this construction, heat from the electrode is transferred to the metal member, so that the temperature of the electrode can be prevented from excessively rising. Consequently, the lamp life can be increased.

BRIEF DESCRIPTION OF THE DRAWINGS

These and other objects, advantages and features of the invention will become apparent from the following description thereof taken in conjunction with the accompanying drawings which illustrate a specific embodiment of the invention. In the drawings:

FIG. 3 is a table showing results of a first experiment to test the lives and luminous efficacies of metal halide lamps, with the ratio of a weight B (mg) of a electrode sealing part L to a weight A (mg) of a metal member 7 being changed for each metal halide lamp;

FIG. 4 is a table showing results of a second experiment to test the lives of metal halide lamps and to see whether the lamps would extinguish, with the ratio of a tube current $I_{la}$ (A) during lamp operation in the stable state to an outer diameter D (mm) of an electrode 4 being changed for each metal halide lamp; and FIG. 5 is a table showing results of a third experiment to test the lives of metal halide lamps and to see whether cracks would occur to the lamps, with a ratio of a length d (mm) measured along the electrode 4 from the boundary between a light emitting unit 1 and a sealing unit 2 to the discharge side end of the metal member 7 being changed to an outer diameter OD (mm) of the metal member 7.

DESCRIPTION OF PREFERRED EMBODIMENT

The following is a description of an embodiment of the present invention, with reference to the drawings.

Figure 1:
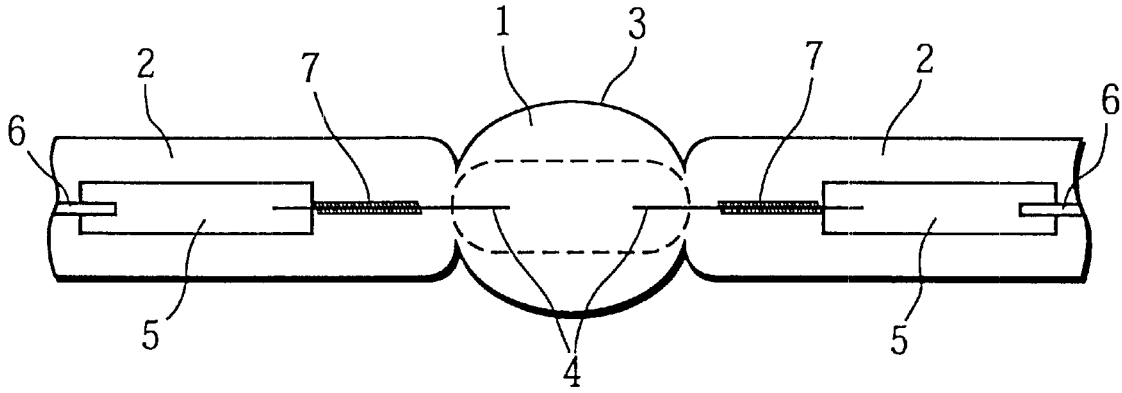
FIG. 1 is a front view of a metal halide lamp of an embodiment of the present invention, the metal halide lamp having 35 W of lamp wattage.
Figure 2:
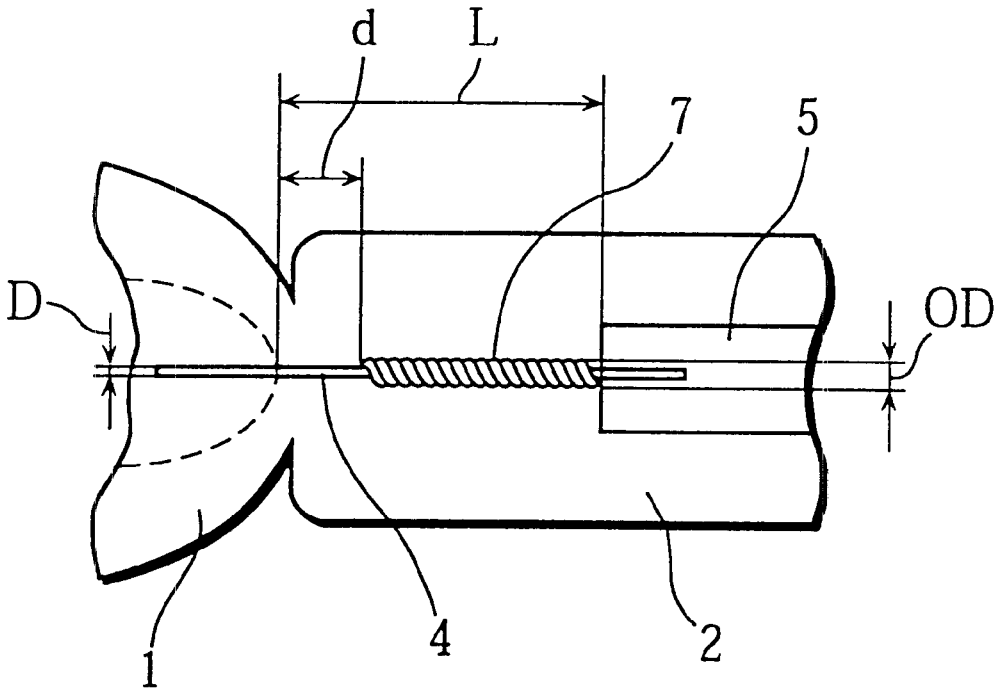
FIG. 2 is an enlarged view of an essential part of the metal halide lamp.

FIG. 1 is a front view of a metal halide lamp of an embodiment of the present invention, the metal halide lamp having 35 W of lamp wattage. FIG. 2 is an enlarged view of an essential part of the metal halide lamp. The metal halide lamp of the present invention is in the shape of spheroid at the middle in the direction of the length. The metal halide lamp has an arc tube 3 that is composed of a light emitting part 1 and a pair of sealing parts 2. The light emitting part 1 has a maximum outer diameter of 6 mm and a length of 8 mm, and has a discharge chamber inside. A sealing part 2 is positioned at both ends of the light-emitting part 1, and has a length of 13 mm and a diameter of 4 mm. The arc tube 3 is made of material, such as quarts glass. A pair of electrodes 4 are extended from both ends of the arc tube 3 into the discharge chamber of the light emitting part 1 so that the ends of the electrodes 4 face each other at a predetermined distance in the discharge chamber. Each electrode 4 is made of tungsten. The tungsten may be doped with a predetermined amount of thorium oxide. In the present embodiment, the length between the facing ends of the pair of electrodes 4 is 4 mm. Each electrode 4 is connected to an external lead wire 6 by a conductor 5 that is sealed in the sealing part 2, the conductor 5 being made of material such as a molybdenum foil.

Each electrode 4 of the present embodiment is rod-like and has a diameter of 0.25 mm and a length of 7 mm. Out of the electrode 4 sealed in the sealing part 2, a part lying from the boundary between the light emitting part 1 and the sealing part 2 to the discharge side end of the conductor 5 is referred to as the electrode sealing part L (see FIG. 2). Hereinafter, the boundary between the light emitting part 1 and the sealing part 2 is simply referred to as the "boundary." The "discharge side end" used in the present specification refers to an inner end that is positionally nearer to the position where discharge takes place than the other (outer) end. A length of the electrode sealing part L is 4 mm. The electrode sealing part L is partially covered by a metal member 7. The metal member 7 of the present embodiment is a coil having a single-layered structure made by winding a tungsten wire with a thickness of 60 $\mu$m. The wire may be made of tungsten doped with a predetermined amount of thorium oxide. It is preferable to use the same material for making the electrode 4 and the metal member 7. The metal member 7 is fixed to the electrode 4 by resistance welding so that the metal member 7 partially covers the electrode 4 down to the discharge side end of the conductor 5 leaving a predetermined length d (see FIG. 2) uncovered from the boundary.

The resistance welding is performed on the metal member 7 and the electrode 4 at a position near the conductor 5. To be more specific, the position is located at a distance measured along the electrode 4 by two turns of the tungsten wire from the discharge side end of the conductor 5. This is to say, the resistance welding is performed at a position at which the temperature is lower in comparison with the discharge side end of the metal member 7. If the resistance welding is performed at a position where the temperature is to rise during lamp operation, cracks may occur to the sealing part 2. To avoid such cracks, the welded part should be located at a position where the temperature will not rise excessively during lamp operation.

The arc tube 3 is filled with respective predetermined amounts of a metal halogen substance as a light emitting substance, rare gas such as xenon gas as a starting-up gas, and mercury. As the metal halogen substance, sodium iodide, scandium iodide, or mixture of sodium iodide and scandium iodide may be used for example. In particular, when the metal halide lamp of the present invention is to be used as a headlight, the metal halogen substance may be a mixture of sodium iodide and scandium iodide with the mixture ratio ranging from 76:24 to 80:20.

As stated earlier, the material used for making the electrodes may be dispersed when the temperature of the facing discharge side ends of the electrodes 4 excessively rises. The excessive rise in the temperature can be effectively prevented by maintaining the heat capacity of each electrode 4 high. The heat capacity of an electrode is closely related to the weight of the electrode. From this fact, a first experiment was conducted using metal halide lamps each having 35 W of lamp wattage. For the first experiment, these metal halide lamps were made, with the ratio of the weight A (mg) of the metal member 7 to the weight B (mg) of the electrode sealing part L being changed for each metal halide lamp. A power was connected between the external lead wires 6 for each lamp, and the lamp was lit up under 85 V of tube voltage and 0.41 A of tube current. In the present experiment, the life and luminous efficacy were tested for each of the metal halide lamps thus prepared. The results of the first experiment are shown as the table in FIG. 3.

The life test in the present experiment was conducted according to the testing method by which each lamp was repeatedly switched on and off a number of times during a 120-minute cycle. The periods of time during which the lamp stayed on varied. So did the periods of time during which the lamp stayed off. The details of this method is described in the IEC (International Electrotechnical Commission) 60810-(1997). As the substances included in each metal halide lamp that was used in the experiment, mercury was 0.6 mg and metal halogen substance was 0.25 mg. The weight ratio of sodium iodide and scandium iodide was 80:20. The sealing pressure of xenon gas was 0.7 MPa at room temperature. A criterion for evaluating the luminous flux maintenance factor is based on the standard described in the IEC 60810. Specifically, when the luminous flux after 1,500 hours had elapsed since the lamp was lit up was equal to or more than 60% of the initial luminous flux, the luminous flux maintenance factor of the lamp was judged to be appropriate. When the luminous flux after 1,500 hours was less than 60% of the initial luminous flux, the maintenance factor of the lamp was judged to be inappropriate.

When the value found by calculating A/B was equal to or more than 0.2 as in the cases of the examples 1 to 6 and comparative example 2, each luminous flux maintenance factor was equal to or more than 60% and so satisfied the stated criterion. In the case of the comparative example 1, the value of A/B was less than 0.2 and the luminous flux maintenance factor was 55%. The lamp used in the comparative example 1 did not satisfy the stated criterion since the temperature of the electrodes excessively rose. Meanwhile, in the case of the comparative example 2 where the value of A/B exceeded 1.6, the luminous efficacy was less than 80 lm/W and turned out to be impractical. This is because the temperature of the electrodes 4 did not rise enough as required for discharge. This low temperature of the electrodes 4 was ascribable to heat loss of the sealing parts 2. The heat loss was increased due to the considerably-increased heat capacity of the electrodes 4 by means of the metal members 7.

The value of A/B needs to be defined as the inequality $0.2 \leqq A/B \leqq 1.6$ so that the luminous flux maintenance factor will satisfy the stated criterion and that the luminous efficacy will be equal to or more than 80 lm/W that is adequate in practical use. It is more preferable to define the value of A/B as the inequality $0.8 \leqq A/B \leqq 1.4$ so as to attain the luminous flux maintenance factor equal to or more than 70%.

With the construction of the metal halide lamp of the present invention according to the inequality, the temperature of the electrodes 4 can be prevented from excessively rising by transferring the excessive heat from the electrodes 4 to the metal members 7. Therefore, the lamp life can be increased.

Even if the value of A/B is within the range expressed as the stated inequality, there may be a case where the temperature of the electrodes 4 excessively rises. Such a excessive rise in the temperature of the electrode will take place when, for example, the outer diameter of the electrode 4 is extremely small while the passage of tube current through the electrode 4 is extremely great. In view of this assumption, a second experiment was conducted.

The second experiment was conducted using metal halide lamps having 35 W of lamp wattage as in the case of the first experiment. For manufacturing these metal halide lamps used in the second experiment, the ratio of the weight A (mg) of the metal member 7 to the weight B (mg) of the electrode sealing part L was set to be within 0.7 to 0.9, and the ratio of a tube current $I_{la}$ (A) during lamp operation in the stable state to the outer diameter D (mm) of the electrode 4 was changed for each metal halide lamp. In the second experiment, the luminous flux maintenance factor was checked for each thus prepared lamp after 1,500 hours had elapsed since the lamp was lit up. The results of the second experiment are shown as the table in FIG. 4.

Each lamp was lit up under the same conditions including the tube voltage and tube current as in the case of the first experiment. The criterion for evaluating the luminous flux maintenance factor was also the same.

When the value found by calculating $I_{la}/D$ was equal to or more than 2.5 as in the cases of the examples 7 to 10 and comparative example 3, each luminous flux maintenance factor was equal to or more than 60% and so satisfied the stated criterion. In the case of the comparative example 3 where the value of $I_{la}/D$ was less than 1.2, flicker occurred and the lamp was extinguished at sometimes. This is because the discharge could not be kept stable. The unstable discharge was ascribable to that the tube current value was too small for the outer diameter D of the electrode 4, making hard for the discharge to shift from the glow discharge phase to the arc discharge phase. Meanwhile, in the case of the comparative example 4 where the value of $I_{la}/D$ exceeded 2.5, the luminous flux maintenance factor was 45%, far below the criterion. This is because the temperature of the electrodes 4 excessively rose. The excessive rise in the temperature was caused by that the tube current value was too great for the outer diameter D of the electrode 4 even though the heat capacity of the electrode 4 was large by means of the metal member 7.

The value of $I_{la}/D$ needs to be defined as the inequality $1.2 \leqq I_{la}/D \leqq 2.5$ so that the luminous flux maintenance factor will satisfy the stated criterion and flicker or extinguishment will not occur to the lamp. It is more preferable to define the value of $I_{la}/D$ as the inequality $1.2 \leqq I_{la}/D \leqq 1.7$ so as to attain the luminous flux maintenance factor equal to or more than 70%.

With the construction of the metal halide lamp of the present invention according to the stated inequality, the tube current value can be appropriately set with respect to the outer diameter D of the electrode 4. Also, the temperature of the electrodes 4 can be prevented from excessively rising by transferring the excessive heat from the electrodes 4 to the metal members 7. Therefore, the lamp life can be increased.

The inequality $1.2 \leqq I_{la}/D \leqq 2.5$ can hold not only within the inequality $0.7 \leqq A/B \leqq 0.9$ but also within the inequality $0.2 \leqq A/B \leqq 1.6$. It is preferable to satisfy the inequality $1.2 \leqq I_{la}/D \leqq 2.5$ when using the metal halide lamp with the lamp wattage equal to or less than 70 W.

When the rod-like electrode 4 as used in the present embodiment is sealed in the sealing part 2, there would be a slight clearance between the electrode 4 and the sealing part 2. In the present embodiment, each electrode 4 is circular in cross section in the direction perpendicular to the axial direction of the electrode 4. The greater the diameter of the electrode 4, the larger the clearance. When an electrode that is polygon in cross section is used, a clearance between the electrode and the sealing part will be larger as compared with a case where the electrode is circular in cross section. When the clearance is large, the substances in the light emitting part 1 enter into the clearance. As a result of the entry of the substances into the clearance, the amount of light emitting substance, namely, the metal halogen substance, included in the light emitting part 1 is reduced, thereby decreasing the luminous flux maintenance factor at an early stage of lamp operation. In view of the clearance between the electrode 4 and the sealing part 2, a third experiment was conducted.

The third experiment was conducted using metal halide lamps having 35 W of lamp wattage. For manufacturing these metal halide lamps used for the present experiment, the ratio of the length d (mm) to an outer diameter OD (mm) (see FIG. 2) of the metal member 7 was changed for each metal halide lamp. In the third experiment, the luminous flux maintenance factor was checked for each thus prepared lamp after 1,500 hours had elapsed since the lamp was lit up. The results of the third experiment are shown as the table in FIG. 5. Each lamp was lit up under the same conditions including the tube voltage and tube current as in the case of the first and second experiments. The criterion for evaluating the luminous flux maintenance factor was also the same.

When the value found by calculating d/OD was equal to or more than 0.5 as in the cases of the examples 11 to 14 and comparative example 6, each luminous flux maintenance factor was equal to or more than 65% and so satisfied the stated criterion. In the case of the comparative example 5 where the value of d/OD was less than 0.5, the luminous flux maintenance factor was 50% and did not satisfy the stated criterion. This is because the amount of the metal halogen substance included in the light emitting part 1 was reduced since the substances entered a lot into the sealing part 2. Meanwhile, in the case of the comparative example 6 where the value of d/OD exceeded 3.5, cracks appeared on the sealing parts 2 within 1,000 hours since the lamp was lit up. The cracks were ascribable to distortion occurring to the sealing parts 2 due to a difference in coefficient of thermal expansion between the electrodes 4 and the sealing parts 2.

The value of d/OD needs to be defined as the inequality $0.5 \leqq d/OD \leqq 3.5$ so that the luminous flux maintenance factor will satisfy the stated criterion and cracks will not occur to the sealing parts 2. It is more preferable to define the value of d/OD as the inequality $1.6 \leqq d/OD \leqq 3.5$ so as to attain the luminous flux maintenance factor equal to or more than 70%.

With the construction of the metal halide lamp of the present invention according to the stated inequality, the hermeticity of the sealing parts 2 can be adequately maintained so as to prevent the metal halogen substance included in the light emitting part 1 from entering into the sealing parts 2. This enables the lamp life to be increased. Also, even if there is a difference in coefficient of thermal expansion between the electrodes 4 and the sealing parts 2, distortion can be prevented from occurring to the sealing parts 2.

As explained up to this point, the present invention can provide a long-life metal halide lamp that prevents the temperature of the electrodes from excessively rising.

Note that it is preferable that a length by which the metal member 7 covers the electrode sealing part L is equal to or more than half the length of the electrode sealing part L. This can be said in consideration of uniformity in hermeticity and evenness of heat balance.

The same effect as stated in the present embodiment can be achieved when the metal halide lamp is set inside a reflecting mirror of a lamp.

In the present embodiment, the metal member 7 is a coil having a single-layered structure. However, the metal member 7 may be a coil having a double-layered structure. Alternatively, the metal member 7 may be in the shape of cylinder. With the double-layered structure or the cylindrical shape of the metal member 7, the same effect as stated in the present embodiment can be achieved.

Although the present invention has been fully described by way of examples with reference to the accompanying drawings, it is to be noted that various changes and modifications will be apparent to those skilled in the art.

Therefore, unless such changes and modifications depart from the scope of the present invention, they should be construed as being included therein.

What is claimed is:

1. A metal halide lamp comprising:

an arc tube made up of a light emitting part and a sealing part at each end of the light emitting part, the light emitting part including a discharge chamber that contains a metal halogen substance;

a pair of electrodes that each extend from the sealing part and have inner and outer ends, the inner ends facing each other at a predetermined distance in the discharge chamber so that discharge takes place between the facing inner ends, and the outer ends being sealed in the sealing parts and connected to conductors sealed in the sealing parts; and a pair of metal members that are attached to the pair of electrodes in a one-to-one relationship, each metal member partially covering an electrode within a length measured along the electrode from a boundary between the light emitting part and the sealing part to an inner end of the conductor, wherein an inequality of $0.2 \leqq A/B \leqq 1.6$ is satisfied, where A is a weight of the metal member and B is a weight of a part of the electrode between the boundary and the inner end of the conductor, and wherein an inequality $0.5 \leqq d/OD \leqq 3.5$ is satisfied, where OD is an outer diameter of the metal member and d is a length of the electrode measured from the boundary to an inner end of the metal member.

2. The metal halide lamp of claim 1, wherein an inequality of $1.2 \leqq I_{la}/D \leqq 2.5$ is satisfied, where D is an outer diameter (mm) of the electrode and $I_{la}$ is a tube current (A) during a lamp operation in a stable state.

3. The metal halide lamp of claim 2, wherein the metal member is a coil made of a refractory metal wire.

4. The metal halide lamp of claim 3, wherein the refractory metal wire is fixed to the electrode at a position near the conductor by performing a welding process.

5. The metal halide lamp of claim 4, wherein the refractory metal wire covers the electrode from the inner end of the conductor by a length of at least L/2 (mm), where L is a length (mm) of the electrode that is measured from the boundary to the inner end of the conductor.

6. The metal halide lamp of claim 5, wherein the length L is approximately 4 mm.

7. The metal halide lamp of claim 6, wherein the conductor is a molybdenum foil.

8. The metal halide lamp of claim 5, wherein the electrode is made of one of tungsten and tungsten doped with a predetermined amount of thorium oxide.

9. The metal halide lamp of claim 5, wherein the refractory metal wire is made of one of tungsten and tungsten doped with a predetermined amount of thorium oxide.

10. The metal halide lamp of claim 2, wherein a lamp wattage during the lamp operation at the stable state is no more than 70 W.

11. The metal halide lamp of claim 2, wherein the metal member is cylindrical.

12. A metal halide lamp having a light emitting housing with a discharge chamber with a pair of electrodes extending into the discharge chamber from a boundary of a sealing portion with the discharge chamber so that a discharge occurs between the electrodes to cause an arc with a metal halogen compound providing a light emission of luminous flux of at least 60% of the initial luminous flux after 1500 hours of operation, comprising:

a pair of metal members, one of the metal members mounted respectively about each of the electrodes and satisfies the following equation:

$$0.5 \leqq d/OD \leqq 3.5$$

where OD is an outer diameter of the metal member and d is a length of the electrode measured from the boundary to an inner end of the metal member, and $$1.2 \leqq I_{la}/D \leqq 2.5$$

where D is an outer diameter (mm) of the electrode and $I_{la}$ is a current (A) during a lamp operation in a stable state.

13. The metal halide lamp of claim 12 where the following equation is satisfied:

$$0.8 \leqq A/B \leqq 1.4$$

where A is a weight of the metal member and B is a weight of a part of the electrode between the boundary and an inner end of a conductor, connected to the electrode and sealed in the light emitting housing.

14. The metal halide lamp of claim 12 wherein the metal members are coils made of a refractory metal wire and each metal member is fixed to an electrode at a position near its conductor by a weld.

15. The metal halide lamp of claim 12 wherein the electrode is made of tungsten doped with a predetermined amount of thorium oxide.

16. The metal halide lamp of claim 12 wherein the refractory metal wire is made of one of tungsten and tungsten doped with a predetermined amount of thorium oxide.

17. The metal halide lamp of claim 12 wherein the metal members are cylindrical tubes.

* * * * *